US005903922A

United States Patent [19]

Vargason

[11] Patent Number: 5,903,922

[45] Date of Patent: May 18, 1999

[54] REMOVABLE UNDERGARMENT FOR USE BENEATH STANDARD CLOTHING

[76] Inventor: Melvin S. Vargason, 2368 45th Ave., Columbus, Nebr. 68601-2145

[21] Appl. No.: 09/065,184

[22] Filed: Apr. 23, 1998

[51] Int. Cl.[6] ..... A41D 1/06

[52] U.S. Cl. ..... 2/78.1; 2/114; 2/227; 2/69

[58] Field of Search ..... 2/78.1, 78.2, 78.3, 2/79, 80, 114, 227, 228, 238, 69, 911, 912, 914, 919

[56] References Cited

U.S. PATENT DOCUMENTS

| | | | |
|---|---|---|---|
| D. 231,155 | 4/1974 | Bowcut | 2/227 |
| 3,800,330 | 4/1974 | Bowcut | 2/227 |
| 4,258,440 | 3/1981 | McGowan | 2/114 |
| 4,638,509 | 1/1987 | Charron | 2/227 X |
| 4,651,353 | 3/1987 | Walden | 2/227 |
| 4,914,756 | 4/1990 | Grassick | 2/227 |
| 5,008,962 | 4/1991 | Smith et al. | 2/234 |
| 5,097,535 | 3/1992 | Dye et al. | 2/227 X |
| 5,315,716 | 5/1994 | Baum | 2/227 |
| 5,535,450 | 7/1996 | Melzer | 2/227 X |

*Primary Examiner*—Gloria M. Hale

[57] ABSTRACT

A undergarment for allowing quick wearing thereof. The device includes a panel having a body portion and elongate first and second leg portions. The body portion has a pair of ends and first and second sides extending between the ends of the body portion. The ends of the body portion are attachable to each other at the first and second sides of the body member such that a space for receiving the lower torso of a user is formed. The first leg portion is extended from the first side of the body portion, and the second leg portion is extended from the second side of the body portion. The side edges of the first leg portion are attachable to one another such that a tubular first pant leg is formed adapted for inserting a leg of a user therein while the side edges of the second leg portion are attachable to one another such that a tubular second pant leg is formed adapted for inserting a leg of a user therein.

1 Claim, 2 Drawing Sheets

REMOVABLE UNDERGARMENT FOR USE BENEATH STANDARD CLOTHING

BACKGROUND OF THE INVENTION

1. Field of the Invention

The present invention relates to undergarments, in particular, long underwear commonly known as long johns and more particularly pertains to undergarment for allowing quick wearing thereof.

2. Description of the Prior Art

The use of undergarments, in particular, long underwear commonly known as long johns is known in the prior art. More specifically, undergarments, in particular, long underwear commonly known as long johns heretofore devised and utilized are known to consist basically of familiar, expected and obvious structural configurations, notwithstanding the myriad of designs encompassed by the crowded prior art which have been developed for the fulfillment of countless objectives and requirements.

Known prior art undergarments, in particular, long underwear commonly known as long johns include U.S. Pat. No. 5,084,914; U.S. Pat. No. 4,914,756; U.S. Pat. No. 4,145,763; U.S. Pat. No. 4,835,795; U.S. Pat. No. 4,651,353; and U.S. Pat. No. Des. 316,923.

While these devices fulfill their respective, particular objectives and requirements, the aforementioned patents do not disclose a new undergarment. The inventive device includes a panel having a body portion and elongate first and second leg portions. The body portion has a pair of ends and first and second sides extending between the ends of the body portion. The ends of the body portion is attachable to each other at the first and second sides of the body member such that a space for receiving the lower torso of a user is formed. The first leg portion is extended from the first side of the body portion, and the second leg portion is extended from the second side of the body portion. The side edges of the first leg portion are attachable to one another such that a tubular first pant leg is formed adapted for inserting a leg of a user therein while the side edges of the second leg portion are attachable to one another such that a tubular second pant leg is formed adapted for inserting a leg of a user therein.

In these respects, the undergarment according to the present invention substantially departs from the conventional concepts and designs of the prior art, and in so doing provides an apparatus primarily developed for the purpose of allowing quick wearing thereof.

SUMMARY OF THE INVENTION

In view of the foregoing disadvantages inherent in the known types of undergarments, in particular, long underwear commonly known as long johns now present in the prior art, the present invention provides a new undergarment construction wherein the same can be utilized for allowing quick wearing thereof.

The general purpose of the present invention, which will be described subsequently in greater detail, is to provide a new undergarment apparatus and method which has many of the advantages of the undergarments, in particular, long underwear commonly known as long johns mentioned heretofore and many novel features that result in a new undergarment which is not anticipated, rendered obvious, suggested, or even implied by any of the prior art undergarments, in particular, long underwear commonly known as long johns, either alone or in any combination thereof.

To attain this, the present invention generally comprises a panel having a body portion and elongate first and second leg portions. The body portion has a pair of ends and first and second sides extending between the ends of the body portion. The ends of the body portion is attachable to each other at the first and second sides of the body member such that a space for receiving the lower torso of a user is formed. The first leg portion is extended from the first side of the body portion, and the second leg portion is extended from the second side of the body portion. The side edges of the first leg portion are attachable to one another such that a tubular first pant leg is formed adapted for inserting a leg of a user therein while the side edges of the second leg portion are attachable to one another such that a tubular second pant leg is formed adapted for inserting a leg of a user therein.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new undergarment apparatus and method which has many of the advantages of the undergarments, in particular, long underwear commonly known as long johns mentioned heretofore and many novel features that result in a new undergarment which is not anticipated, rendered obvious, suggested, or even implied by any of the prior art undergarments, in particular, long underwear commonly known as long johns, either alone or in any combination thereof.

It is another object of the present invention to provide a new undergarment which may be easily and efficiently manufactured and marketed.

It is a further object of the present invention to provide a new undergarment which is of a durable and reliable construction.

An even further object of the present invention is to provide a new undergarment which is susceptible of a low cost of manufacture with regard to both materials and labor, and which accordingly is then susceptible of low prices of sale to the consuming public, thereby making such undergarment economically available to the buying public.

Still yet another object of the present invention is to provide a new undergarment which provides in the apparatuses and methods of the prior art some of the advantages thereof, while simultaneously overcoming some of the disadvantages normally associated therewith.

Still another object of the present invention is to provide a new undergarment for allowing quick wearing thereof.

Yet another object of the present invention is to provide a new undergarment which includes a panel having a body portion and elongate first and second leg portions. The body portion has a pair of ends and first and second sides extending between the ends of the body portion. The ends of the body portion is attachable to each other at the first and second sides of the body member such that a space for receiving the lower torso of a user is formed. The first leg portion is extended from the first side of the body portion, and the second leg portion is extended from the second side of the body portion. The side edges of the first leg portion are attachable to one another such that a tubular first pant leg is formed adapted for inserting a leg of a user therein while the side edges of the second leg portion are attachable to one another such that a tubular second pant leg is formed adapted for inserting a leg of a user therein.

Still yet another object of the present invention is to provide a new undergarment that allows a user to easily put on a pair of long johns when wearing shoes or boots.

Even still another object of the present invention is to provide a new undergarment that allows outdoor enthusiasts to put on an extra undergarment on out in the field to dress appropriately for changing weather conditions.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
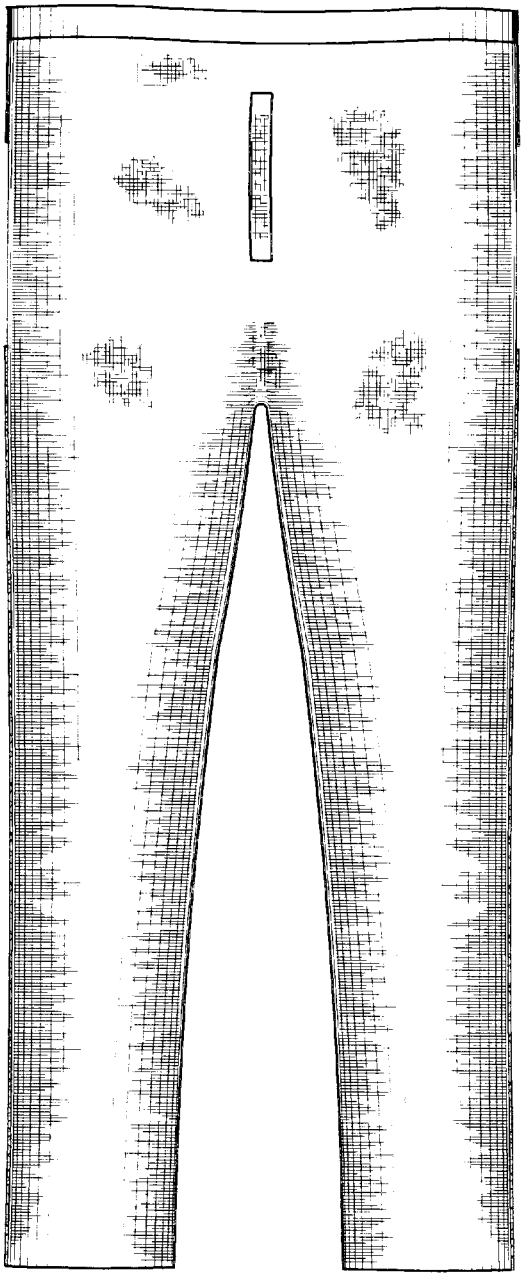
FIG. 1 is a front view of the present invention.
Figure 2:
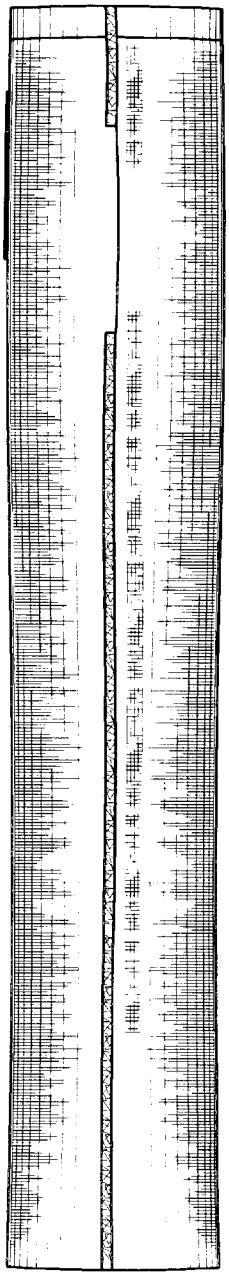
FIG. 2 is a side view of the present invention.
Figure 3:
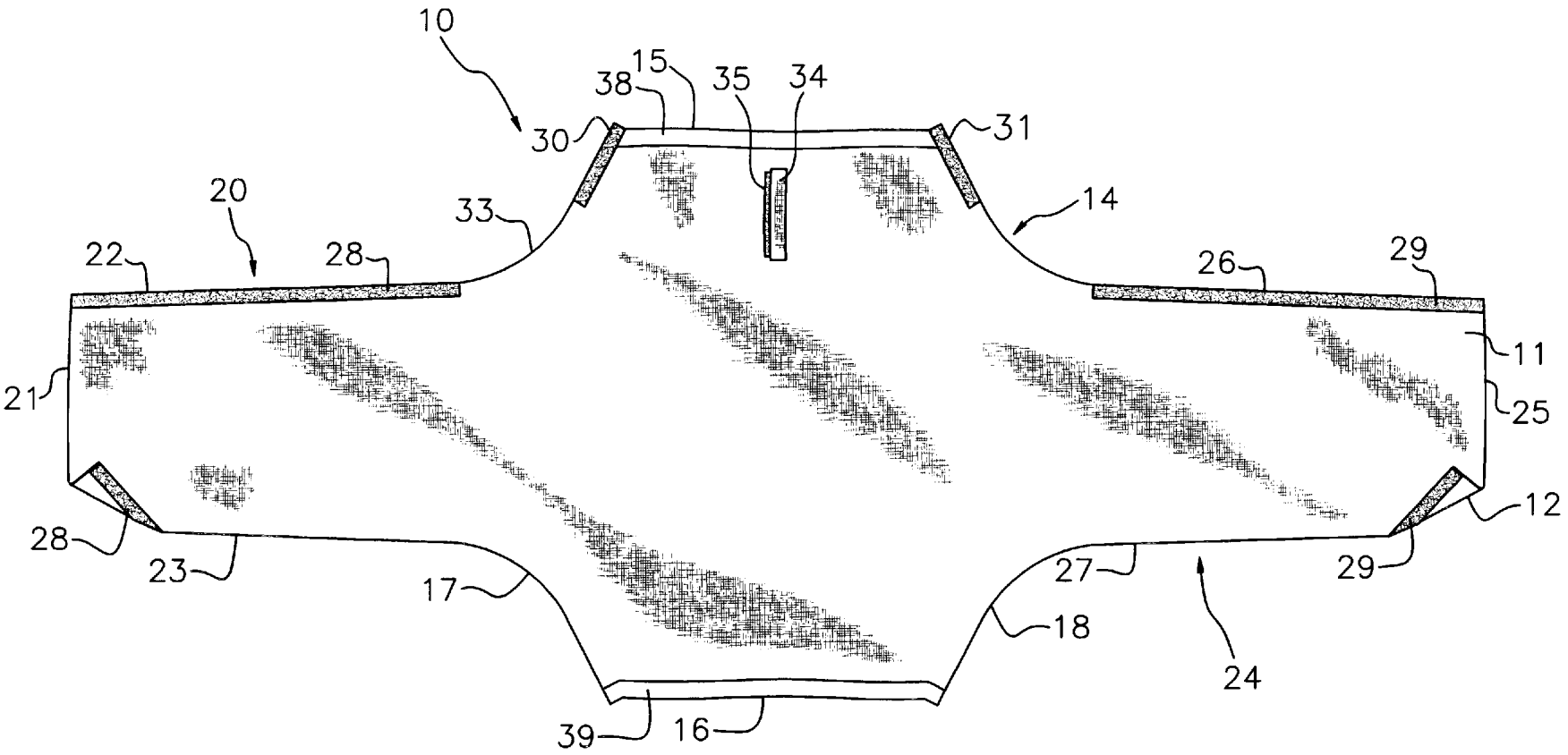
FIG. 3 is a an open plan view of the present invention.

With reference now to the drawings, and in particular to FIGS. 1 through 3 thereof, a new undergarment embodying the principles and concepts of the present invention and generally designated by the reference numeral 10 will be described.

As best illustrated in FIGS. 1 through 3, the undergarment 10 generally comprises a panel having a body portion 14 and elongate first and second leg portions 20,24. The body portion 14 has a pair of ends 15,16 and first and second sides 17,18 extending between the ends 15,16 of the body portion 14. The ends 15,16 of the body portion 14 is attachable to each other at the first and second sides 17,18 of the body member such that a space for receiving the lower torso of a user is formed. The first leg portion 20 is extended from the first side 17 of the body portion 14, and the second leg portion 24 is extended from the second side of the body portion 14. The side edges 22,23 of the first leg portion 20 are attachable to one another such that a tubular first pant leg is formed adapted for inserting a leg of a user therein while the side edges 26,27 of the second leg portion 24 are attachable to one another such that a tubular second pant leg is formed adapted for inserting a leg of a user therein.

In closer detail, the panel is made of a fabric material and has first and second surfaces 11,12 and a body portion 14 and elongate first and second leg portions 20,24. The body portion 14 is generally rectangular and has a pair of ends 15,16 and first and second sides 17,18 extending between the ends 15,16 of the body portion 14. With reference to FIG. 2, the ends 15,16 of the body portion 14 are detachably attachable to each other at the first and second sides 17,18 of the body member such that a portion of the each side adjacent one of the ends is attachable to another portion of the same side adjacent the other end of the body portion. This attachment forms a space for receiving the lower torso of a user. As shown in FIG. 3, preferably, a hook and loop fastener 30,31 attaches the ends 15,16 of the body portion 14 together at each of the sides of the body portion 14 with a hook and loop fastener extending from the ends 15,16 of the body portion 14 towards the closest side edge of the leg portions. In the preferred embodiment, each of the ends 15,16 of the body portion 14 also has an resiliently elastic elongate strip 38,39 extending therealong between the first and second sides 17,18 of the body portion 14. Ideally, the body portion 14 has an slit opening 34 extending between the first and second surfaces 11,12 of the panel. The slit opening 34 of the body portion 14 is positioned towards one of the ends 15 of the body portion 14 and is ideally closed with a hook and loop fastener 35.

With referent to FIG. 3, the first leg portion 20 is extended from the first side 17 of the body portion 14. The first leg portion 20 has a free end 21 distal the first side 17 of the body portion 14 and a pair of side edges 22,23 extending between the free end 21 of the first leg portion 20 and the first side 17 of the body portion 14. Similarly, the second leg portion 24 is extended from the second side 18 of the body portion 14. Like the first leg portion, the second leg portion 24 also has a free end 25 distal the second side 18 of the body portion 14 and a pair of side edges 26,27 extending between the free end 25 of the second leg portion 24 and the second side of the body portion 14. As shown in FIG. 3, ideally, an arcuate region 33 is formed at the intersection of each of the side edges and their respective side of the body portion. As illustrate in FIG. 1, the side edges 22,23 of the first leg portion 20 are detachably attachable to one another along their length such that a tubular first pant leg is formed adapted for inserting a leg of a user therein and has a lower opening at the free end 21 of the first leg portion 20 and an upper opening adjacent first side 17 of the body portion 14. Similarly, the side edges 26,27 of the second leg portion 24 are detachably attachable to one another along their length such that a tubular second pant leg is formed adapted for inserting a leg of a user therein and also has a lower opening at the free end 25 of the second leg portion 24 and an upper opening adjacent second side of the body portion 14.

Preferably, a hook and loops fasteners 28,29 attach each of respective the side edges 21,22,26,27 of the each of leg portions 20,24 together. The hook and loop fastener 28 of the first leg portion 20 is extended from the free end 21 of the first leg portion 20 towards the first side 17 of the body portion 14, while the hook and loop fastener 29 of the second leg portion 24 is extended from the free end of the second leg portion 24 towards the second side of the body portion 14. Each hook and loop fastener has a pair of complementary portions with one portion located on the first surface of the panel member and the other portion is located on the second surface of the panel member.

In use, the undergarment may be put on by a user already wear pants by first dropping the user's pants, and then placing the body portion 14 between the user's legs near the user's crotch. The ends of the body portion are lifted upwards and the sides of the ends of the body portion are then coupled together. The legs portions are wrapped around their respective leg of the user and their side edges are then attached together.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An undergarment, comprising:

a single unitary panel formed from a single piece of material and having continuous first and second surfaces and a body portion and elongate first and second leg portions;

said body portion being generally rectangular and having a pair of ends and first and second sides extending between said ends of said body portion;

wherein the sides of the body portion each define a single continuous curve between the ends of the body portion and the leg portions;

wherein a width of each of the leg portions tapers from top to bottom along an entire length thereof;

said ends of said body portion being attachable to each other at said first and second sides of said body member such that a space for receiving the lower torso of a user is formed, wherein a hook and loop fastener attaches said ends of said body portion together at each of said sides of said body portion;

wherein a length of each hook and loop fastener that attaches said ends of said body portion together is about ⅓ that of one of the continuous curves;

each of said ends of said body portion having a resiliently elastic elongate strip extending therealong between said first and second sides of said body portion;

said body portion having an slit opening extending between said first and second surfaces of said panel, said slit opening of said body portion being positioned towards and spaced slightlv from the elastic elongate strip of one of said ends of said body portion, wherein a hook and loop fastener closes said slit opening;

said first leg portion being extended from said first side of said body portion, said first leg portion having a free end distally located with respect to said first side of said body portion and a pair of side edges extending between said free end of said first leg portion and said first side of said body portion;

said second leg portion being extended from said second side of said body portion, said second leg portion having a free end distally located with respect to said second side of said body portion and a pair of side edges extending between said free end of said second leg portion and said second side of said body portion;

said side edges of said first leg portion being detachably attachable to one another along their entire length such that a tubular first pant leg is adapted for inserting a leg of a user therein;

said side edges of said second leg portion being detachably attachable to one another along their entire length such that a tubular second pant leg is adapted for inserting a leg of a user therein;

wherein a first hook and loops fastener attaches said side edges of said first leg portion together, wherein said hook and loop fastener of said first leg portion is extended from said freed end of said first leg portion towards said first side of said body portion; and wherein a second hook and loops fastener attaches said side edges of said second leg portion together, wherein said second hook and loop fastener of said second leg portion is extended from said freed end of said second leg portion towards said second side of said body portion.

* * * * *